US008780153B2

(12) United States Patent
Yamaji

(10) Patent No.: US 8,780,153 B2
(45) Date of Patent: Jul. 15, 2014

(54) THERMAL HEAD

(75) Inventor: Norio Yamaji, Takamatsu (JP)

(73) Assignee: AOI ELectronics Co., Ltd., Takamatsu-shi (JP)

( * ) Notice: Subject to any disclaimer, the term of this patent is extended or adjusted under 35 U.S.C. 154(b) by 0 days.

(21) Appl. No.: 13/519,170

(22) PCT Filed: Jun. 17, 2010

(86) PCT No.: PCT/JP2010/060274
§ 371 (c)(1),
(2), (4) Date: Jun. 26, 2012

(87) PCT Pub. No.: WO2011/092874
PCT Pub. Date: Aug. 4, 2011

(65) Prior Publication Data

US 2012/0287216 A1 Nov. 15, 2012

(30) Foreign Application Priority Data

Jan. 29, 2010 (JP) ..... 2010-017643

(51) Int. Cl.
*B41J 2/335* (2006.01)

(52) U.S. Cl.
CPC ..... *B41J 2/33505* (2013.01); *B41J 2/3353* (2013.01)
USPC ..... 347/203

(58) Field of Classification Search
USPC ..... 347/200, 202, 203
See application file for complete search history.

(56) References Cited

U.S. PATENT DOCUMENTS

| | | | | |
|---|---|---|---|---|
| 5,315,319 | A * | 5/1994 | Sato et al. | 347/200 |
| 5,917,531 | A * | 6/1999 | Nagahata et al. | 347/202 |
| 6,236,423 | B1 * | 5/2001 | Yamaji | 347/203 |
| 6,683,636 | B2 * | 1/2004 | Goto et al. | 347/171 |
| 7,697,020 | B2 * | 4/2010 | Yamade | 347/208 |

* cited by examiner

*Primary Examiner* — Huan Tran
(74) *Attorney, Agent, or Firm* — Westerman, Hattori, Daniels & Adrian, LLP

(57) ABSTRACT

A thermal head wherein abrasion of an insulating protection film of a heating resistor formed on a partial glaze layer can be suppressed. A heating resistor is provided on the partial glaze layer provided on a ceramic substrate in the longitudinal direction, and the entire surface including the heating resistor is covered by the insulating protection film. A level difference is formed between the insulating protection film over the heating resistor and a flat portion of the insulating protection film over the area outside of the partial glaze layer. The level difference is set so that the insulating protection film on the heating resistor defines a higher portion and a platen roller can press thermal paper on the insulating protection film over the heating resistor and on the flat insulating protection film outside of the partial glaze layer. Thereby, the pressing force of the platen roller can be dispersed.

6 Claims, 4 Drawing Sheets

THERMAL HEAD

TECHNICAL FIELD

The present invention relates to a thermal head.

BACKGROUND ART

FIG. 8 is a partial sectional view illustrating one example of a thermal head, and FIG. 9 is a partial plan view illustrating the layout of a heating resistor and electrodes.

As illustrated in FIG. 8, a partial glaze layer 2 having a convex shape and made of glass, for example is disposed on an insulating substrate 1, such as a ceramic substrate. Further, a common electrode, a comb-shaped electrode extending from the common electrode, and a plurality of individual electrodes (described below with reference to FIG. 9), those electrodes being each made of an electrically conductive material, e.g., gold, are disposed on the partial glaze layer 2. Still further, a heating resistor 3 made of ruthenium oxide, for example, is linearly formed over the individual electrodes and the comb-shaped electrode on the partial glaze layer 2 (see Patent Document 2 as one example of the thermal head including the partial glaze layer).

In addition, an electrically insulating protection film 4 (hereinafter referred to as an "insulating protection film 4") made of a $PbO—SiO_2—ZrO_2$ based glass material, for example, coveres substantially over the entire surface of the insulating substrate 1, including the partial glaze layer 2, the heating resistor 3 and the electrodes. A sheet of thermal paper 8 serving as a printing medium is conveyed while it is pressed by a platen roller 7 against the insulating protection film 4 so that a color is developed with heat generated by the heating resistor 3 and then transferred through the insulating protection film 4.

Moreover, as illustrated in FIG. 9, the color development in the thermal paper 8 is performed by supplying a current to the heating resistor 3 so as to heat individual heating resistor elements in units of one dot, which are each present between the comb-shaped electrode 6*a* extending from the common electrode 6 and one of the individual electrodes 5. Thus, the insulating protection film 4 serves to ensure mechanical protection and electrical insulation, and hence the insulating protection film 4 is required to have mechanical strength and electrical insulation performance in excess of certain levels.

PRIOR ART LIST

Patent Documents

Patent Document 1: Japanese Patent No. 3603997

Patent Document 2: Japanese Patent Unexamined Publication No. 2001-232838

SUMMARY OF THE INVENTION

Problems to be Solved by the Invention

However, the above-described thermal head has the problem that, depending on the type of thermal paper as the printing medium, the insulating protection film 4 is significantly abraded due to friction with the thermal paper, including a pigment, etc. contained therein, and that the mechanical strength and the electrical insulation performance of the insulating protection film 4 are degraded.

Further, some thermal paper, e.g., label paper, has a relatively large thickness. In view of that type of thermal paper, there is a tendency to set a pressing pressure of the platen roller 7 to a higher lever for the purpose of improving a following capability with respect to the thermal head.

In that case, the abrasion of the insulating protection film 4 is accelerated with the higher pressing pressure of the platen roller 7. Meanwhile, it is also experimentally proved that abrasion resistance of the insulating protection film 4 against the above-mentioned friction with the thermal paper is greatly affected by a coverage rate at which printing is performed by the thermal head on the thermal paper.

Thus, an amount of abrasion tends to become larger at a higher coverage rate than at a lower coverage rate. Such a tendency is attributable to the influence, described below, that is imposed on the thermal head at the higher coverage rate rather than the lower coverage rate. More specifically, when the heating resistor generates heat, there occurs a temperature distribution having a peak in a central portion. At the higher coverage rate, the heat generated in the central portion is more apt to accumulate as a result of a synergistic effect with heat generated in adjacent portions of the heating resistor, particularly when the printing operation is continuously repeated. Accordingly, temperature reaches neat the transition point of the insulating protection film 4, whereby the insulating protection film 4 can no longer maintain the inherent hardness and becomes more susceptibly reactive to mechanical stresses, e.g., friction.

Under such a condition, the abrasion resistance of the insulating protection film 4 is easily degraded because the thermal paper 8 is conveyed over the insulating protection film 4 while the thermal paper 8 is pressed by the platen roller 7.

Particularly, in an environment when the thermal head is used at a printing speed of 200 mm/s or higher, the heat generated by the heating resistor is more apt to accumulate, thus raising a problem how to maintain the abrasion resistance.

To cope with that problem, a thermal head is proposed in which an electrically conductive protection film having good thermal conductivity is disposed as an additional protection layer on the insulating protection film (see Patent Document 1).

However, even when the insulating protection film 4 is made not so susceptibly reactive to mechanical stresses, e.g., friction, by averaging the heating temperature inside the heating resistor, there still remains a possibility that the abrasion resistance of the insulating protection film may be degraded depending on the thermal paper used.

With the view of solving the problems described above, the present invention provides a thermal head in which an insulating protection film can maintain high abrasion resistance while maintaining satisfactory efficiency of color development in printing performance.

Means for Solving the Problems

A level difference is provided between an insulating protection film covering a heating resistor, which is disposed on a partial glaze layer, and a flat portion of the insulating protection film over an area outside the partial glaze layer. The level difference is set such that a platen roller can press thermal paper against the flat portion of the insulating protection film as well at the side close to the partial glaze layer.

Advantageous Effect of the Invention

A pressing pressure of the platen roller is distributed without being concentrated onto the insulating protection film positioned on the heating resistor, whereby mechanical abrasion of the insulating protection film can be suppressed.

DESCRIPTION OF EMBODIMENTS

Figure 9:
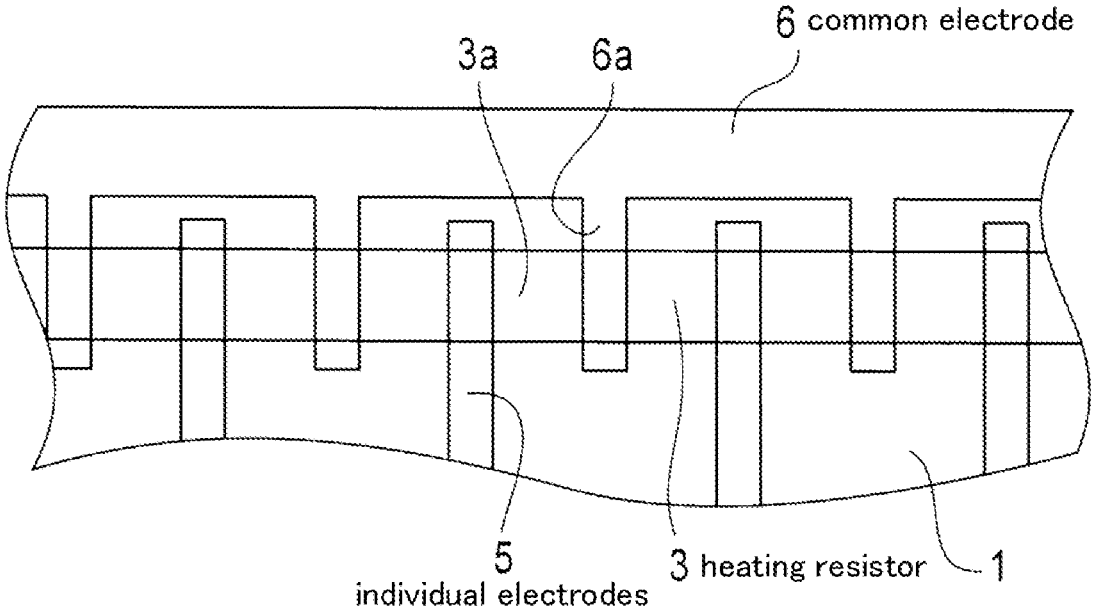
FIG. 9 is a partial plan view illustrating the layout of electrodes and a heating resistor in the thermal head according to the present invention and the thermal head of related art.

As illustrated in FIG. 9, color development in a printing medium, such as thermal paper, is performed by causing the heating resistor 3 made of ruthenium oxide ($RuO_2$), for example, to generate heat in individual heating resistor elements 3*a* in units of one dot, which are each present between the comb-shaped electrode 6*a* extending from the common electrode 6 made of an electrically conductive material, e.g., gold, and one of the individual electrodes 5 made of an electrically conductive material, e.g., gold. Hereinafter, the comb-shaped electrode and the individual electrodes are collectively referred to as "power feed electrodes".

Figure 1:
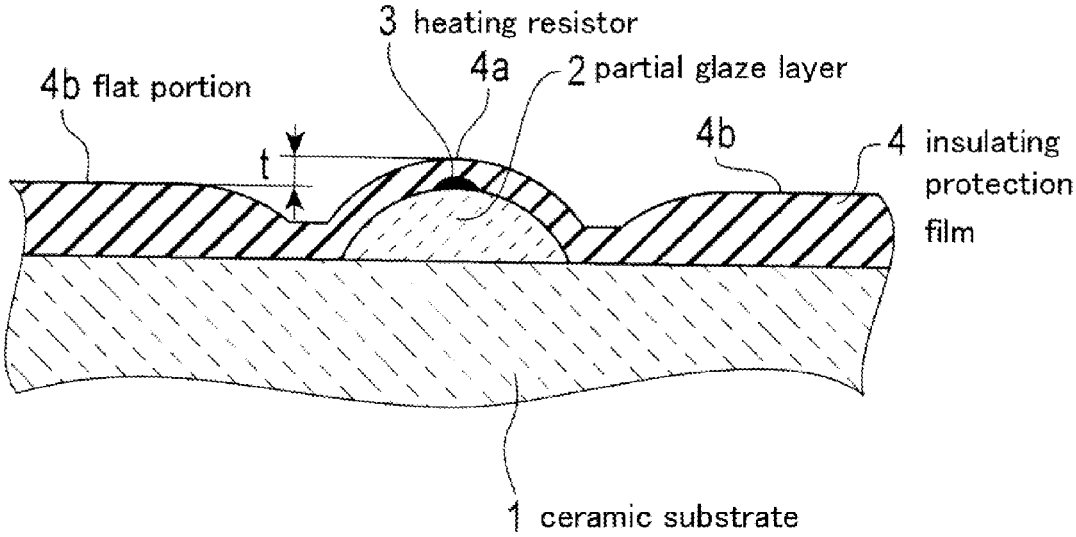
FIG. 1 is a partial sectional view of a thermal head according to the present invention.
Figure 2:
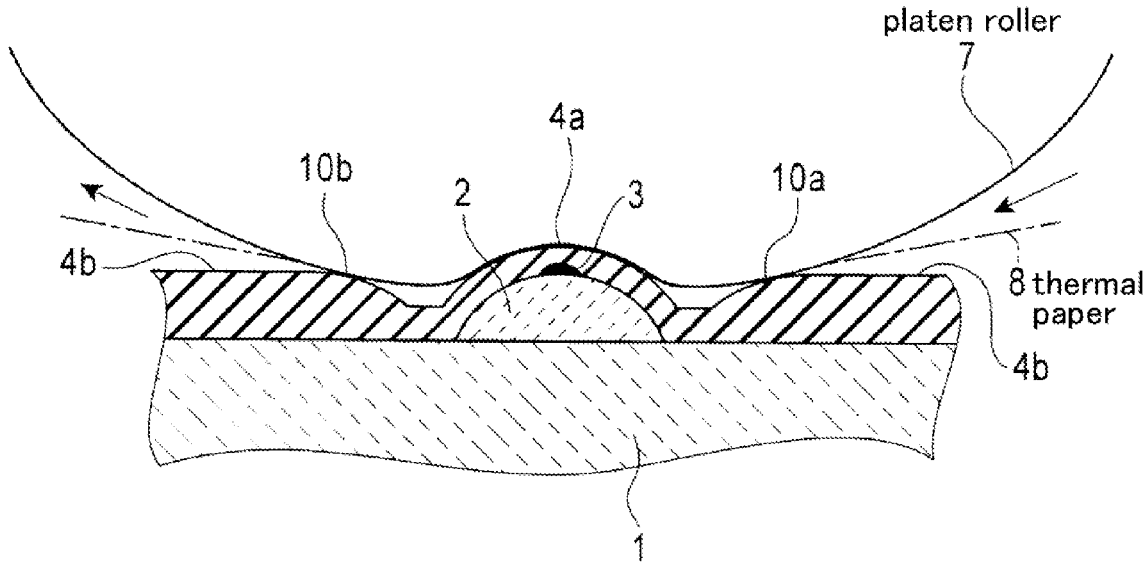
FIG. 2 is a partial sectional view to explain the operation of the thermal head according to the present invention.

Further, as illustrated in FIGS. 1 and 2, on an electrically insulating ceramic substrate 1 made of alumina $Al_2O_3$, for example, a partial glaze layer 2 made of glass, for example, is disposed to extend in the lengthwise direction of the ceramic substrate 1 (i.e., in the direction perpendicular to a drawing sheet) such that the partial glaze layer 2 occupies a partial area in the widthwise direction of the ceramic substrate 1 and it has a linear shape in the lengthwise direction thereof.

The heating resistor 3 is disposed on the partial glaze layer 2 in an overlapped relation to the comb-shaped electrode 6*a* and the individual electrodes 5 (FIG. 9), which are disposed on the partial glaze layer 2. The insulating protection film 4 is disposed over the entire surface of the ceramic substrate 1, including the partial glaze layer 2, the heating resistor 3, and the power feed electrodes. The insulating protection film 4 is made of a $PbO—SiO_2—ZrO_2$ based glass material, for example.

There is a level difference t between an insulating protection film 4*a* positioned on the surface of the heating resistor 3, which is disposed on the partial glaze layer 2, and a flat portion 4*b* of the insulating protection film in an area outside the partial glaze layer 2. A size of the level difference t is set such that the platen roller 7 presses the thermal paper 8 against surfaces 10*a* and 10*b* of the flat portion 4*b* of the insulating protection film as well, the surfaces 10*a* and 10*b* being each positioned at the side close to the partial glaze layer 2.

In this respect, the flat portion 4*b* of the insulating protection film 4 is formed as follows. After forming the insulating protection film 4 so as to cover the heating resistor 3 and the power feed electrodes as illustrated in FIG. 3(A), the above-mentioned glass material is coated over areas except for the partial glaze layer 2 by means of screen printing, for example, thereby simultaneously forming upper insulating protection films 4*c* and 4*d*, as illustrated in FIG. 3(B).

As one example, when thermal paper having a thickness of 65 μm is used as a printing medium as described later, the height of the flat portion 4*b* is set to a level lowered by 15 μm (i.e., t=15 μm) such that the platen roller 7 presses the thermal paper against the surfaces 10*a* and 10*b* (FIG. 2) as well.

With the presence of the level difference t, the platen roller 7 can press the thermal paper against not only the insulating protection film 4*a* on the heating resistor 3, but also the surfaces 10*a* and 10*b* of the flat portion 4*b* of the insulating protection film 4. Therefore, a pressing force of the platen roller is distributed to the surfaces 10*a* and 10*b* without being concentrated onto the insulating protection film 4*a* on the heating resistor 3, whereby mechanical abrasion of the insulating protection film 4 can be suppressed.

Further, the surface 10*a* of the insulating protection film, which is positioned on the entry side of the thermal paper 8 with respect to the partial glaze layer 2, causes an action to improve smoothness of the thermal paper 8 at the same time. Such an action contributes to further suppressing the mechanical abrasion of the insulating protection film 4*a* on the heating resistor 3.

An example of a method of forming the insulating protection film 4 providing the above-mentioned level difference t will be described below.

Figure 3:
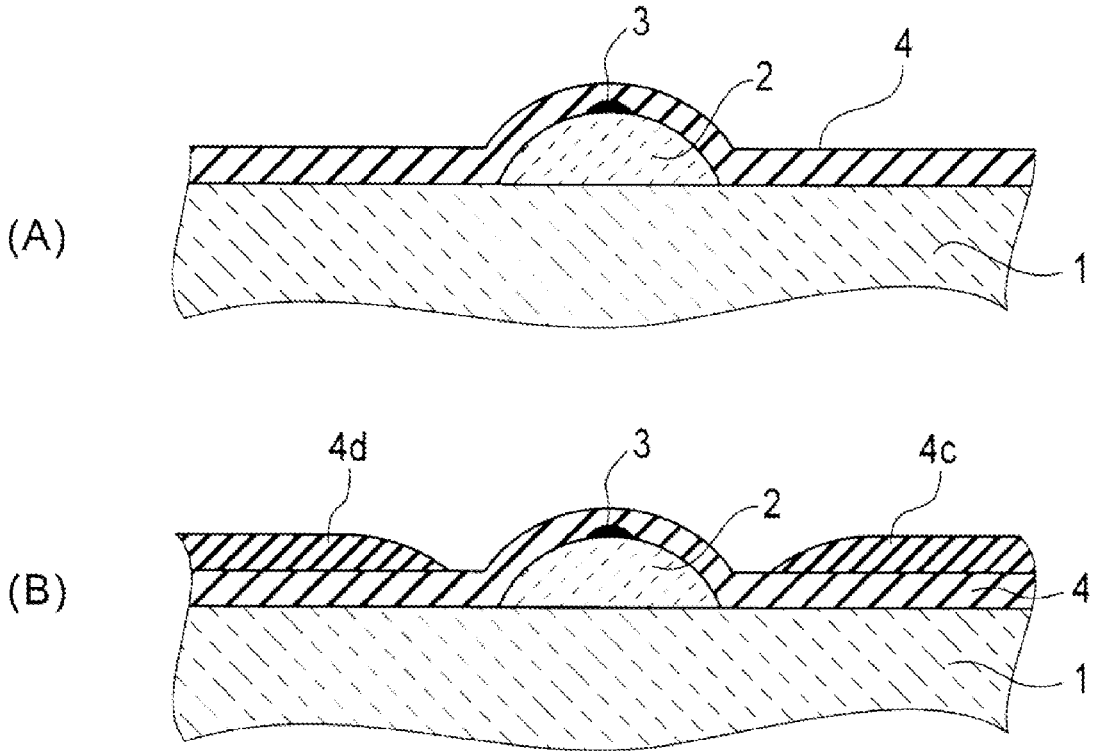
FIG. 3 is a partial sectional view of an embodiment of the thermal head according to the present invention.

After forming the insulating protection film 4 to extend in a state riding across the partial glaze layer 2 as illustrated in FIG. 3, auxiliary insulating films 4*c* and 4*d* are formed up to a height that provides a level difference enabling the platen roller to press the thermal paper at both the sides of the partial glaze layer 2. As an alternative, auxiliary insulating films may be formed on the ceramic substrate 1 in advance, and the insulating protection film 4 may be then formed to extend in a state riding across the partial glaze layer 2.

Figure 4:
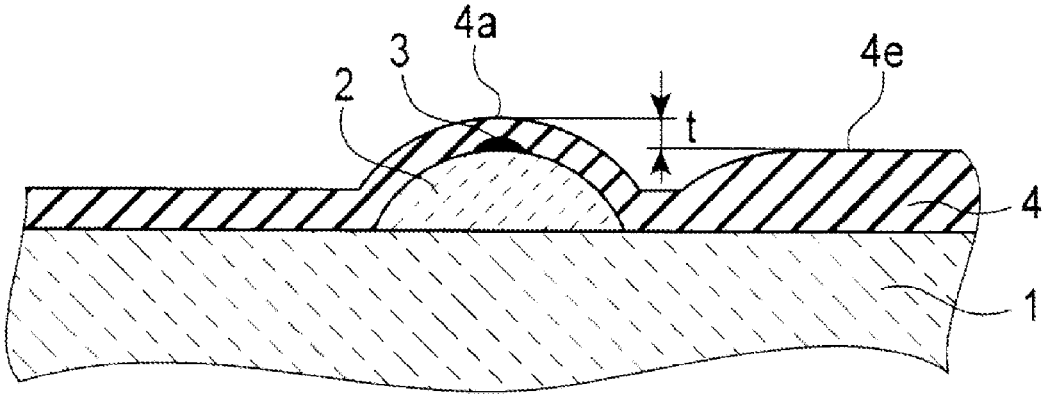
FIG. 4 is a partial sectional view of an embodiment of the thermal head according to the present invention.
Figure 5:
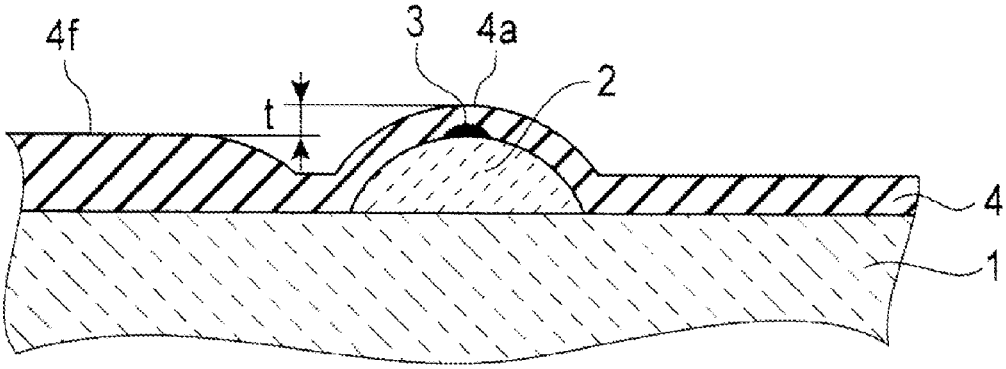
FIG. 5 is a partial sectional view of an embodiment of the thermal head according to the present invention.

Further, other forming methods may be practiced, as illustrated in FIGS. 4 and 5, such that the platen roller presses the flat portion of the insulating protection film at one side of the partial glaze layer. In that case, the insulating protection film formed to be flat at a height lower than the insulating protection film 4*a* on the heating resistor 3 by the level difference t is formed as an insulating protection film 4*e* or an insulating protection film 4*f*, which is positioned respectively at the entry side or the exiting side of the thermal paper with respect to the partial glaze layer 2.

Figure 6:
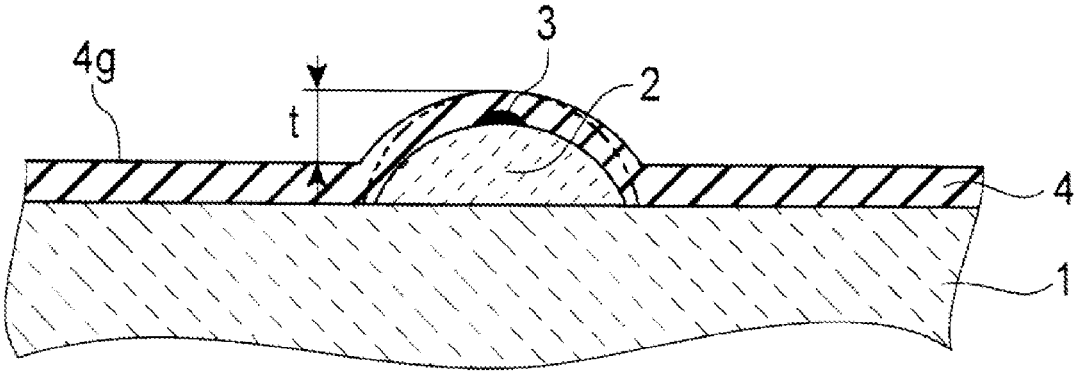
FIG. 6 is a partial sectional view of an embodiment of the thermal head of the present invention.

In still another embodiment, as illustrated in FIG. 6, when, after forming the partial glaze layer 2 on an upper surface of the ceramic substrate 1 to linearly extend in the lengthwise direction of the ceramic substrate 1 and to occupy a partial area in the widthwise direction of the ceramic substrate 1, the power feed electrodes, the heating resistor 3, and the insulating protection film 4*g* are successively formed thereon, the thickness of a flat portion 4*g* of the insulating protection film 4 is adjusted so as to provide the level difference t enabling the platen roller to be contacted with the flat portion 4*g*.

Figure 7:
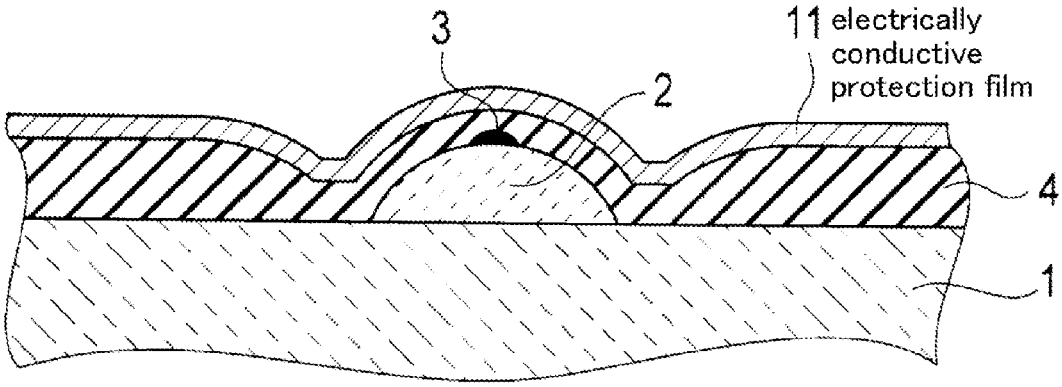
FIG. 7 is a partial sectional view of an embodiment of the thermal head according to the present invention.

In still another embodiment, as illustrated in FIG. 7, a two-layered structure is formed which includes, as a lower layer, the insulating protection film 4 providing the above-described level difference and, as an upper layer, an electrically conductive protection film 11 having high thermal conductivity, which is primarily made of, for example, ruthenium oxide, other metal oxides of silicon, zirconium and lead, and glass, and which has a sheet resistance value of 0.5 M to 10 MΩ/□, preferably a sheet resistance value of 1 MΩ/□.

In one example, the electrically conductive protection film 11 is made of a material having thermal conductivity of 9.628 W/mK, and the insulating protection film 4 as the lower layer is made of a material having thermal conductivity of 1.616 W/mK. Because the electrically conductive protection film 11 has high thermal conductivity and provides a structure having superior heat transference, it can momentarily transfer heat to the thermal paper with a good thermal response and can contribute to averaging a heat distribution generated by the heating resistor 3. Therefore, stresses generated in the electrically conductive protection film 11 are suppressed and a mechanical abrasion resistance characteristic is improved as a result of the synergistic effect with the provision of the level difference.

Here, Table 1 indicates a nip width (i.e., a size of the width over which the platen roller contacts the thermal head with the thermal paper interposed between them) when the thermal paper having the thickness of 65 μm is actually pressed by the platen roller under 19.6 N/the thermal head (under 0.27 N/mm (size of the printing width)) in the embodiment of the present invention illustrated in FIG. 1.

TABLE 1

Figure 8:
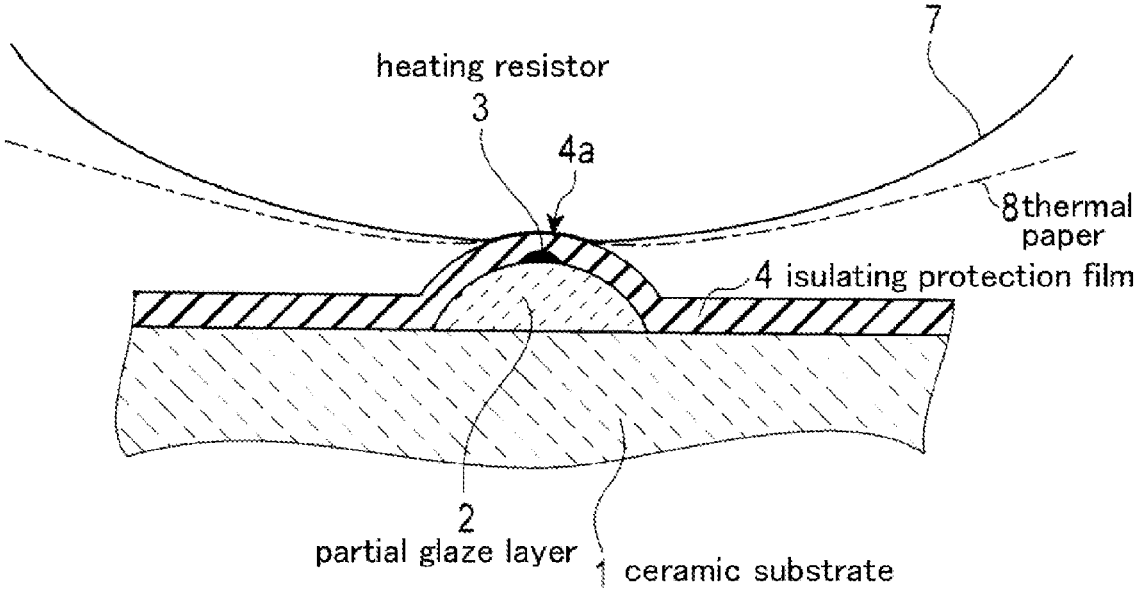
FIG. 8 is a partial sectional view of a thermal head of related art.

| | Case of FIG. 8 | Case of FIG. 1 |
|---|---|---|
| Nip width at 4a (A) | 0.198 mm | 0.263 mm |
| Nip width at 4b (B) (Total at 4b) | . . . | 0.573 mm |
| Total nip width (C) = (A) + (B) | 0.198 mm | 0.836 mm |

<Conditions> Thickness of the thermal paper: 65 μm,

Pressing pressure of the platen roller: 19.6 N/printing width

When the flat portion 4*b* of the insulating protection film is formed to provide the level difference of 15 μm in the embodiment illustrated in FIG. 1, the nip width is increased at a ratio of 0.836 mm/0.198 mm=4.22 and a thermal head having the nip width, which is in total 4.22 times that in the related-art thermal head illustrated in FIG. 8, can be realized.

As a result, the pressing pressure of the platen roller per unit length is reduced to (1/4.22) to the contrary, and mechanical stresses caused by the pressing pressure of the platen roller are reduced correspondingly. Therefore, abrasion of the insulating protection film 4*a* formed on the partial glaze layer 2 is suppressed.

Numerical values indicated in Table 1 represent the results obtained by coating ink over the insulating protection film of the thermal head, causing the platen roller to press the insulating protection film, and then measuring an area where the coated ink has been removed (in terms of size in the widthwise direction).

List of Reference Symbols

1 . . . ceramic substrate, 2 . . . partial glaze layer, 3 . . . heating resistor, 4 . . . insulating protection film, t . . . level difference

The invention claimed is:

1. A thermal head for printing on thermal paper, comprising:

a partial glaze layer with a cross section of a circular segment shape disposed on a flat insulating substrate to extend in a lengthwise direction thereof;

a heating resistor disposed on a top portion of the partial glaze layer and extending in the lengthwise direction; and an insulating protection film covering an entire surface of the insulating substrate, including the heating resistor; and a level difference provided between the insulating protection film on the heating resistor and a flat portion of the insulating protection film over an area outside the partial glaze layer, wherein the level difference has such a size that the insulating protection film on the heating resistor is positioned at a higher level, and that a platen roller pressing thermal paper presses the thermal paper against a surface of the insulating protection film on the heating resistor and against a surface of the flat portion of the insulating protection film over the area outside the partial glaze layer at a side close to the partial glaze layer, thereby distributing a pressing force of the platen roller.

2. The thermal head according to claim 1, wherein the level difference is such that the insulating protection film on the heating resistor is positioned at a higher level by 15 μm.

3. The thermal head according to claim 1, wherein the insulating protection film is made of a $PbO—SiO_2—ZrO_2$ based glass material.

4. The thermal head according to claim 1, wherein an electrically conductive protection film having high thermal conductivity is disposed on the insulating protection film.

5. The thermal head according to claim 1, wherein an electrically conductive protection film having thermal conductivity of 9.628 w/mK is disposed on the insulating protection film.

6. The thermal head according to claim 2, wherein the platen roller pressing thermal paper with a thickness of 65 μm presses the thermal paper against the surface of the insulating protection film on the heating resistor and against the surface of the flat portion of the insulating protection film over the area outside the partial glaze layer at a side close to the partial glaze layer, thereby distributing the pressing force of the platen roller.

* * * * *